US009261253B2

(12) United States Patent
Mochizuki et al.

(10) Patent No.: US 9,261,253 B2
(45) Date of Patent: Feb. 16, 2016

(54) VEHICLE HEADLAMP AND PROJECTION LENS MOUNTING METHOD

(75) Inventors: Katsuhito Mochizuki, Shizuoka (JP); Yukio Nomura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 13/479,311

(22) Filed: May 24, 2012

(65) Prior Publication Data

US 2012/0300484 A1 Nov. 29, 2012

(30) Foreign Application Priority Data

May 24, 2011 (JP) ..... 2011-115462
Feb. 2, 2012 (JP) ..... 2012-020672

(51) Int. Cl.
*F21S 8/10* (2006.01)

(52) U.S. Cl.
CPC ..... *F21S 48/1216* (2013.01); *Y10T 29/49826* (2015.01)

(58) Field of Classification Search
CPC ..... F21S 48/1216
USPC ..... 362/512
See application file for complete search history.

(56) References Cited

U.S. PATENT DOCUMENTS

| | | | | |
|---|---|---|---|---|
| 4,797,790 | A * | 1/1989 | Brodling et al. | 362/538 |
| 4,895,693 | A * | 1/1990 | Suzuki et al. | 362/544 |
| 5,180,219 | A * | 1/1993 | Geddie | 362/546 |
| 2003/0151925 | A1* | 8/2003 | Crunk | 362/545 |
| 2007/0133220 | A1* | 6/2007 | Watanabe et al. | 362/538 |
| 2010/0020548 | A1* | 1/2010 | Tyson et al. | 362/321 |

FOREIGN PATENT DOCUMENTS

| | | | |
|---|---|---|---|
| CN | 2240068 | Y | 11/1996 |
| DE | 19751896 | A1 * | 6/1998 |
| JP | H02-40802 | A | 2/1990 |
| JP | 2008135247 | A | 6/2008 |
| JP | 2009-025591 | A | 2/2009 |
| JP | 2009064713 | A | 3/2009 |

OTHER PUBLICATIONS

English Patent Abstract of JP 2008-135247, Publication Date: Jun. 12, 2008 (1 Page).
Office Action issued in corresponding Chinese Application No. 201210164630.3, mailed Nov. 19, 2014 ( 15 pages).
Notification of the Third Office Action issued in corresponding Chinese Application No. 201210164630.3, mailed on May 15, 2015 (17 pages).
Notification of Reasons for Refusal in corresponding Japanese application No. 2012-020672 dated Sep. 29, 2015 (4 pages).

* cited by examiner

*Primary Examiner* — Thomas A Hollweg
*Assistant Examiner* — Christopher Raabe
(74) *Attorney, Agent, or Firm* — Osha Liang LLP

(57) ABSTRACT

A vehicle headlamp includes a light source configured to emit light, a reflector configured to reflect the light, a projection lens through which the light is projected, and a lens holder holding the projection lens. The projection lens has a positioning portion, and the lens holder is formed with a jig insertion hole at a location corresponding to the positioning portion in a direction around an optical axis of the projection lens such that the positioning portion is visible through the jig insertion hole. When mounting the projection lens to the lens holder, a positioning jig is inserted through the jig insertion hole and is engaged with the positioning portion to position the projection lens in the direction around the optical axis of the projection lens.

3 Claims, 6 Drawing Sheets

VEHICLE HEADLAMP AND PROJECTION LENS MOUNTING METHOD

CROSS-REFERENCE TO RELATED APPLICATIONS

The present application claims priority from Japanese Patent Applications No. 2011-115462 filed on May 24, 2011 and No. 2012-020672 filed on Feb. 2, 2012, the entire contents of which are incorporated herein by reference.

BACKGROUND OF INVENTION

1. Field of the Invention

The present invention relates to a vehicle headlamp and a projection lens mounting method.

2. Related Art

Related art vehicle headlamps have a lamp housing and a lamp unit arranged inside the lamp housing.

The lamp unit may include a light source, a projection lens configured to forwardly project light emitted by the light source, a reflector configured to reflect the light toward the projection lens, and a lens holder holding the projection lens.

A related art vehicle headlamp is configured to irradiate a long range high beam area, a short range low beam area, and also an overhead sign area above the low beam area to improve visibility of overhead road signs (see, e.g., JP 2008-135247A).

Range and illuminance of the overhead sign area to be irradiated are defined by light distribution regulations.

To form a light distribution pattern for the overhead sign area, for example, a lens portion having a specific profile is provided as a light regulating portion at a lower portion of the projection lens.

SUMMARY OF INVENTION

In a vehicle headlamp having a projection lens provided with a light regulating portion, the projection lens may be mounted on a lens holder such that the light regulating portion is in the right position.

To position the projection lens with respect to the lens holder, a positioning recess may be formed in an outer circumferential portion of the projection lens and a positioning protrusion formed on the lens holder so that the positioning protrusion fitted in the positioning recess when the projection lens is properly mounted on the lends holder.

However, when there is a thermal shrinkage or a thermal expansion of the projection lens and the lens holder due to a temperature change, the projection lens may crack due to a difference in a shrinkage rate or an expansion rate between the projection lens and the lens holder.

Further, in terms of improving positioning accuracy of the projection lens with respect to the lens holder, the positioning recess and the positioning protrusion may be formed with high accuracy to provide a good contacting condition (fitting condition) between the projection lens and the lens holder. However, this may increase the likelihood of the cracking of the projection lens.

One or more embodiments of the present invention provide a vehicle headlamp and a projection lens mounting method, according to which a positioning accuracy of a projection lens with respect to a lens holder is improved and a cracking of the projection lens is prevented.

According to one or more embodiments of the present invention, a vehicle headlamp is provided. The vehicle headlamp includes a light source configured to emit light, a reflector configured to reflect the light, a projection lens through which the light is projected, and a lens holder holding the projection lens. The projection lens has a first positioning portion. The lens holder is formed with a jig insertion hole at a location corresponding to the first positioning portion in a direction around an optical axis of the projection lens such that the first positioning portion is visible through the jig insertion hole.

According to one or more embodiments of the present invention, a projection lens mounting method for the vehicle headlamp is provided. The method includes mounting the projection lens to the lens holder such that the positioning portion is visible through the jig insertion hole, inserting a positioning jig through the jig insertion hole, engaging the positioning jig with the positioning portion, and positioning the projection lens in the direction around the optical axis of the projection lens.

Other aspects and advantages of the invention will be apparent from the following description, the drawings and the claims.

DETAILED DESCRIPTION

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

A vehicle headlamp 1 is mounted on each side of a front end portion of a vehicle body.

Figure 1:
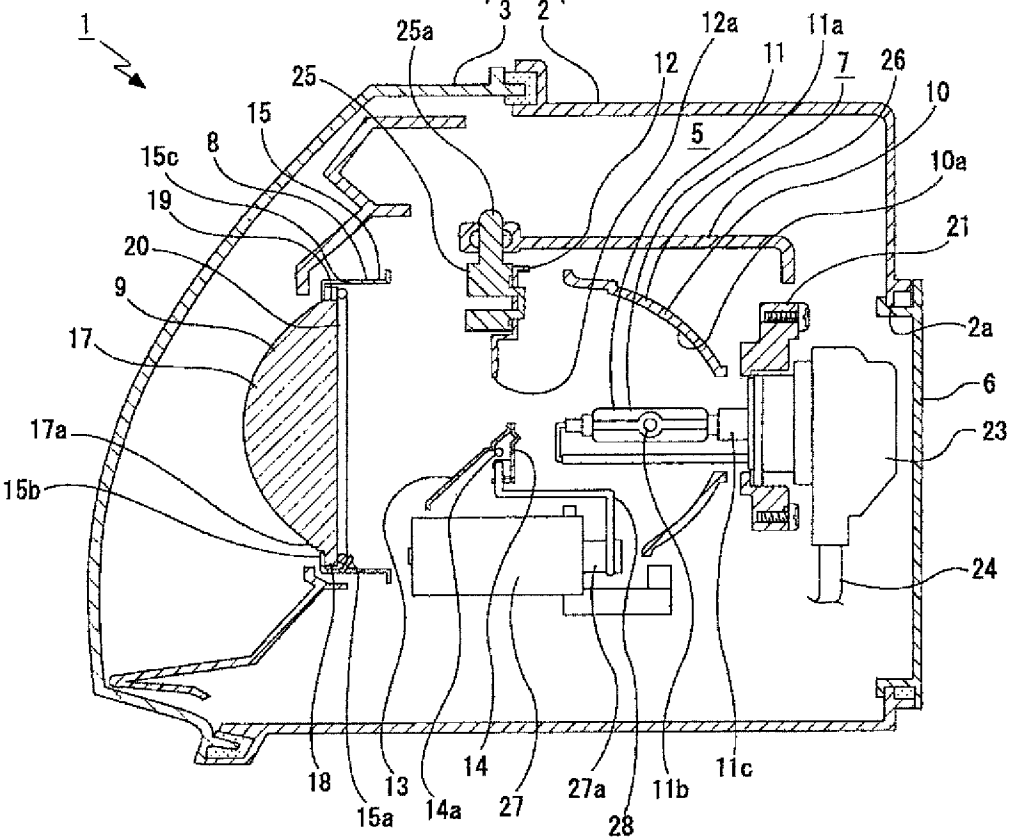
FIG. 1 is a vertical sectional view of a vehicle headlamp according to one or more embodiments of the present invention.

As shown in FIG. 1, the vehicle headlamp 1 includes a lamp body 2 having a front opening and a cover 3 covering the opening of the lamp body 2. The lamp body 2 and the cover 3 form a lamp housing 4, and an interior space in the lamp housing 4 is defined as a lamp chamber 5.

A mounting hole 2*a* is formed in a rear wall of the lamp body 2, and a back cover 6 is attached to the rear wall of the lamp body 2 to close the mounting hole 2*a*.

Figure 2:
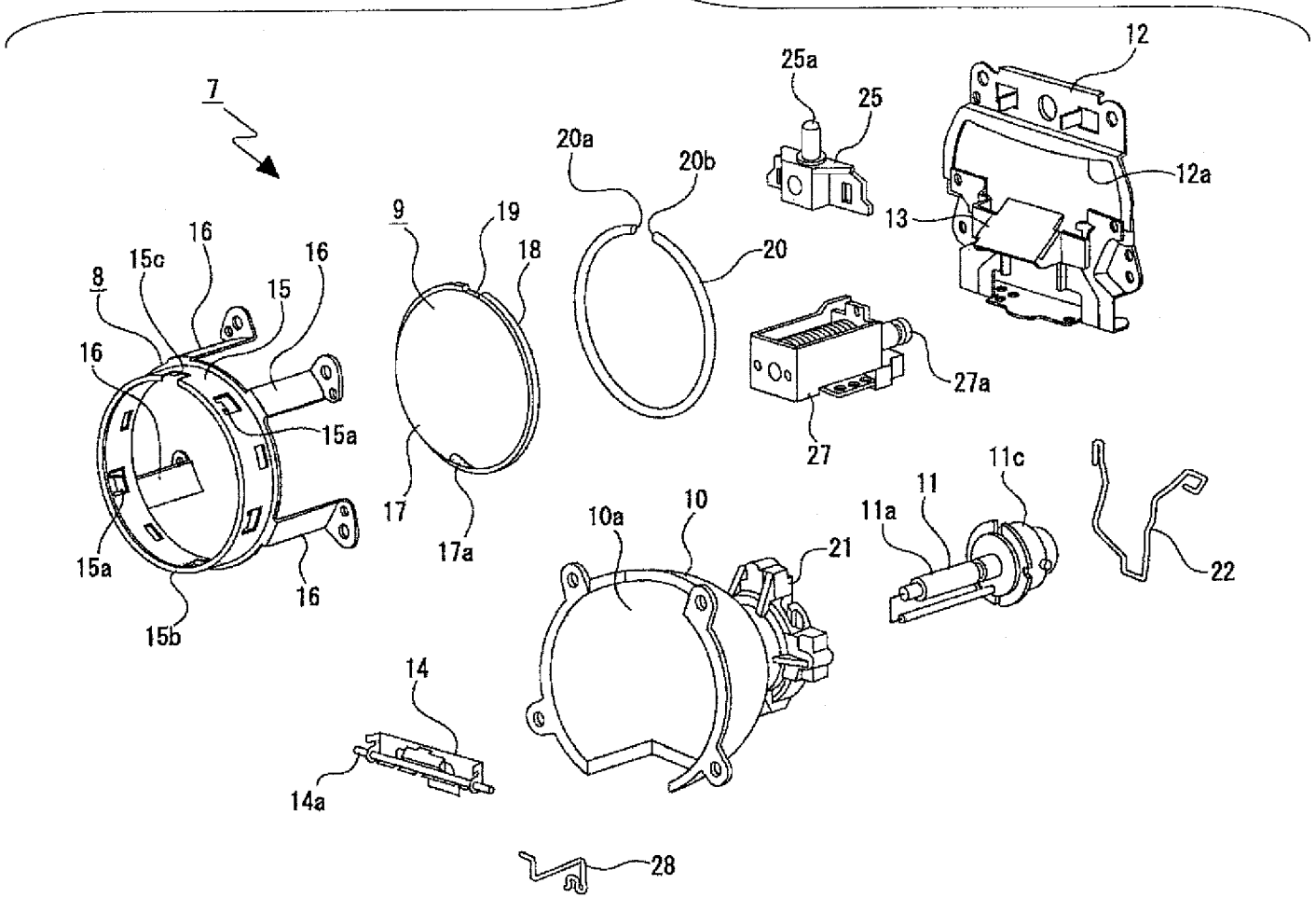
FIG. 2 is an exploded perspective view of a lamp unit of the headlamp.
Figure 3:
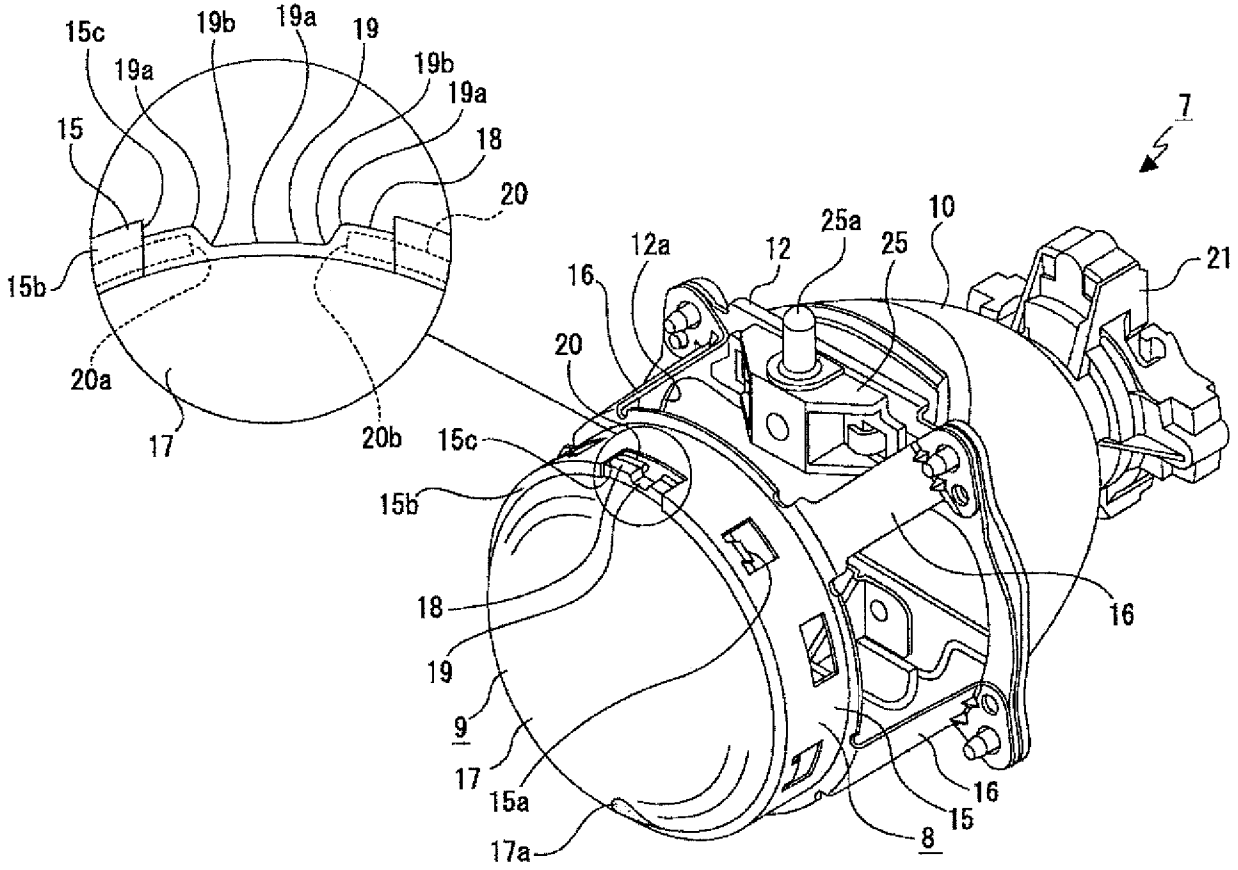
FIG. 3 is a perspective view of the lamp unit.

A lamp unit 7 is disposed in the lamp chamber 5. As shown in FIGS. 1 to 3, the lamp unit 7 has a lens holder 8, a projection lens 9 which is held by the lens holder 8, a reflector 10 arranged behind the lens holder 8, a light source 11 disposed at a rear end of the reflector 10, a mounting frame 12, a fixed shade 13, and a movable shade 14 which blocks, together with the fixed shade 13, a part of light emitted by the light source 11.

The lens holder 8 is made by forming a metal plate. The lens holder 8 includes an annular holding portion 15 and attaching portions 16, each protruding rearward from the holding portion 15. The attaching portions 16 are spaced apart from each other in a circumferential direction.

The holding portion 15 has securing tongues 15*a* arranged such that the securing tongues 15*a* are spaced apart from each other in the circumferential direction. The securing tongues 15*a* are formed by bending corresponding portions of the holding portion 15 radially inward. The holding portion 15 also has a securing wall 15*b* protruding radially inward at a front end of the holding portion 15. An upper portion of the holding portion 15 is formed with a jig insertion hole 15*c*, penetrating the holding portion 15 in a vertical direction.

The projection lens 9 is held at the holding portion 15 of the lens holder 8, and project light emitted by the light source 11 outward from the lamp unit 7. The projection lens 9 includes a substantially semispherical light projecting portion 17 having a convex front surface, and a flange 18 protruding radially outward from an outer circumference of a rear side of the light projecting portion 17. The light projecting portion 17 and the flange 18 are formed as a one-piece structure.

The light projecting portion 17 has a light regulating portion 17*a* at a lower portion of the light projecting portion 17. The light regulating portion 17*a* has one or more lens steps (see, e.g., FIG. 4).

A positioning recess 19 is formed in an upper portion of the flange 18. The positioning recess 19 is opened upward and also toward the front and rear. The positioning recess 19 is an example of a positioning portion configured to position the projection lens 9 with respect to the lens holder 8. Corner portions 19*a*, 19*b* of the positioning recess 19 are formed as curved surfaces (see an enlarged view portion of FIG. 3).

The projection lens 9 is held by the lens holder 8 such that a securing member 20 is attached to the rear surface of the flange 18. The securing member 20 is produced by, for example, forming a metal wire into a ring shape. A gap is provided between one end 20*a* and the other end 20*b* of the securing member 20. The securing member 20 is attached to the projection lens 9 such that the gap between the one end 20*a* and the other end 20*b* is positioned directly behind the positioning recess 19.

In a state in which the flange 18 of the projection lens 9 is inserted in the holding portion 15, a front surface of the flange 18 is held by the securing wall 15*b* from the front and the securing member 20 is held by the securing tongues 15*a* from the rear. That is, the projection lens 9 is held in the lens holder 8 such that the flange 18 is held from the front and rear, between the securing wall 15*b* and the securing tongues 15*a* of the lens holder 8, and together with the securing member 20.

In a state in which the projection lens 9 is held in the lens holder 8, the positioning recess 19 of the projection lens 9 is located such that the positioning recess 19 is visible through the jig insertion hole 15*c* of the holding portion 15.

An inner surface of the reflector 10 is formed as a reflecting surface 10*a*. A mounting member 21 is attached to a rear portion of the reflector 10.

The light source 11 is, for example, a discharge bulb having an outer tube 11*a* and a light emitting portion 11*b* disposed inside the outer tube 11*a* to emit light. The outer tube 11*a* is held by a connecting portion 11*c* disposed at the rear of the outer tube 11*a*, and the connecting portion 11*c* is attached to the mounting member 21 by a fastening spring 22 (see FIGS. 1 to 3).

The connecting portion 11*c* of the light source 11 is connected to a socket 23, to which a cable 24 is connected. The socket 23 is connected to an igniter via the cable 24. A voltage is applied to the light source 11 from the igniter via the cable 24 and the socket 23, whereby the light source 11 is turned on.

The mounting frame 12 is made by forming a plate material. The mounting frame 12 has a hole 12*a* at a vertically central portion so that the light from the light source 11 passes though the hole 12*a* toward the front.

The attaching portions 16 of the lens holder 8 are attached to a front side of the mounting frame 12, and are fastened by means of screws or the like. A front end portion A pivot member 25 is attached at an upper end portion of the mounting frame 12. The pivot member 25 has a pivot shaft 25*a* protruding upward. The pivot shaft 25*a* is rotatably supported by a support plate 26. The support plate 26 is provided in a fixed manner inside the lamp chamber 5.

A shade driving unit 27 is mounted at a lower end portion of the mounting frame 12. The shade driving unit 27 has a plunger 27*a* adapted to move in the front-rear direction.

The fixed shade 13 is attached to the mounting frame 12 at a location above the shade drive unit 27.

The movable shade 14 is rotatably supported by the mounting frame 12 at a location near the fixed shade 13. The movable shade 14 rotates about a shaft 14*a* extending in a lateral direction. The movable shade 14 is coupled to the plunger 27*a* of the shade drive unit 27 via a coupling member 28. The movable shade 14 rotates in response to a movement of the plunger 27*a* in the front-rear direction.

The lamp unit 7 is swiveled by a swiveling drive unit about the pivot shaft 25*a* of the pivot member 25 in a direction that follows the traveling direction of the vehicle, and is controlled so that the light emitted by the light source 11 and projected through the projection lens 9 is irradiated in the traveling direction of the vehicle.

The lamp unit 7 is supported on the lamp body 2 also by a plurality of adjustment shafts. By rotating one or more of the adjustment shafts, the lump unit 7 is tilted in the front-rear direction and/or is turned in the right-left direction with respect to the lamp body 2, whereby an optical axis of the light from the light source 11 is adjusted (i.e., an aiming adjustment).

The vehicle headlamp 1 may also have a leveling adjustment mechanism configured to control the direction of the optical axis of the light source 11 which inclines when the weight of the load on the vehicle varies.

According to the vehicle headlamp 1 described above, when the light from the light source 11 travels straight ahead or is reflected by the reflecting surface 10*a* of the reflector 10, and passes through the hole 12*a* to enter the light projecting portion 17 of the projection lens 9.

A part of the light from the light source 11 is blocked by the fixed shade 13 and the movable shade 14, and the remaining part of the light is projected outside the lamp unit 7 through the projection lens 9. The blocking amount of light is controlled by the rotational position of the movable shade 14, so that a low beam or a high beam is projected through the projection lens 9.

A portion of the light enters the light regulating portion 17*a* of the projection lens 9 and is upwardly output from the light regulating portion 17*a* to irradiate overhead road signs.

Next, a procedure for mounting the projection lens 9 on the lens holder 8 will be described with reference to FIGS. 4 to 6. When mounting the projection lens 9 on the lens holder 8, a mounting jig 100 and a positioning jig 200 are used. A distal end portion of the positioning jig 200 has a shape that fits into the positioning recess 19 of the projection lens 9.

Figure 4:
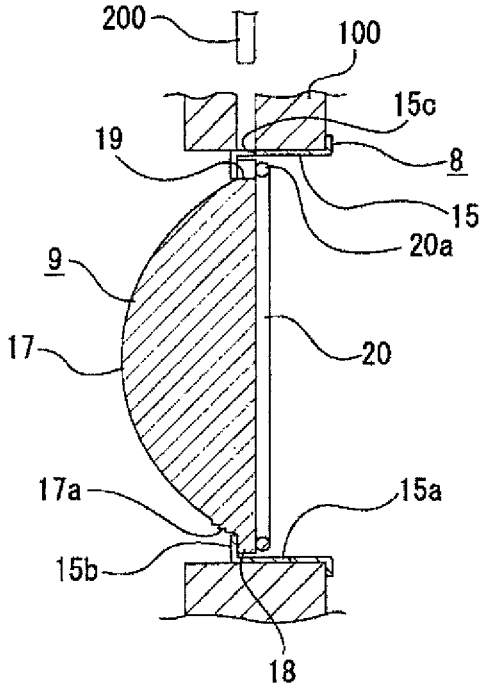
FIG. 4 illustrates, together with FIGS. 5 and 6, a procedure for mounting a projection lens on a lens holder, and is a sectional view illustrating a state in which the lens holder is held by a mounting jig.

First, the lens holder 8 is held by the mounting jig 100 such that the projection lens 9 is inserted into the holding portion 15 of the lens holder 8 from the rear side of the holding portion 15 such that the front surface of the flange 18 contacts the rear surface of the securing wall 15*b* (see FIG. 4). When the projection lens 9 is inserted into the holding portion 15, the securing tongues 15*a* of the holding portion 15 are not bent inward. The projection lens 9 and the lens holder 8 are disposed such that the positioning recess 19 and the jig insertion hole 15*c* are both located at upper positions.

Next, the securing member 20 is disposed such that the securing member 20 is pressed against the rear surface of the flange 18. The securing member 20 is pressed against the rear surface of the flange 18 by being fastened by a fastening jig. The securing member 20 is disposed such that the gap between the one end 20*a* and the other end 20*b* of the securing member 20 is located directly behind the positioning recess 19 of the projection lens 9.

Figure 5:
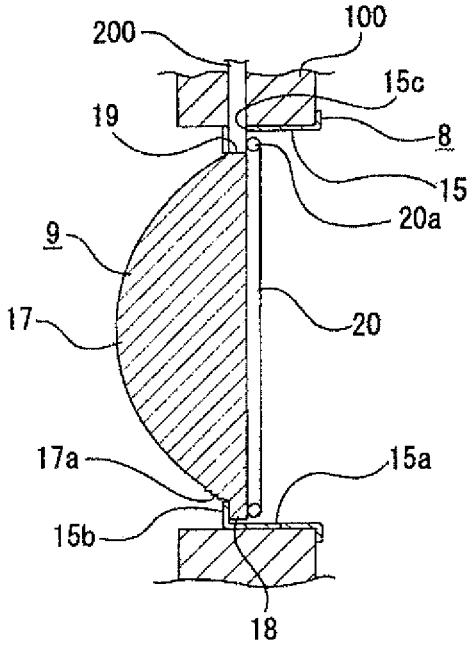
FIG. 5 is a sectional view illustrating a state in which a positioning jig is engaged with a positioning recess.
Figure 6:
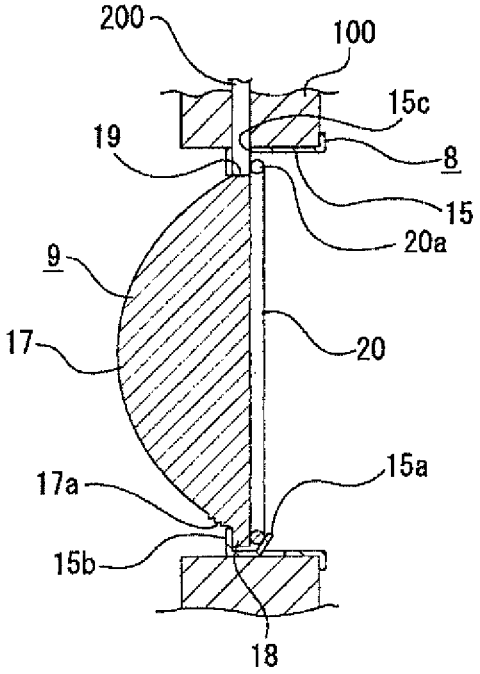
FIG. 6 is a sectional view illustrating a state in which securing tongues are bent to secure the projection lens.

Next, the positioning jig 200 is inserted through the jig insertion hole 15*c* in the lens holder 8 from above the jig insertion hole 15*c*, and the distal end portion (the lower end portion) of the positioning jig 200 is engaged with the positioning recess 19 of the projection lens 9 to position the projection lens 9 with respect to the lens holder 8 in a direction around the optical axis of the projection lens 9 (see FIG. 5). By using the positioning jig 200, the projection lens 9 is positioned such that the light regulating portion 17*a* at the lower portion of the light projecting portion 17 of the projection lens 9 is in a proper position.

As described above, the gap between the one end 20*a* and the other end 20*b* of the securing member 20 is positioned directly behind the positioning recess 19. Therefore, the positioning jig 200 is prevented from hitting the securing member 20, so that the operation of mounting the projection lens 9 in the lens holder 8 improved.

In addition, because the corner portions 19, 19*b* of the positioning recess 9 are rounded, the positioning jig 200 is smoothly inserted into the positioning recess 19, so that the projection lens 9 is prevented from being scratched or abraded.

Following this, the securing tongues 15*a* of the lens holder 8 are bent inward so as to be engaged with the rear side of the securing member 20. Accordingly, the projection lens 9 is held such that the front side of the flange 18 is held by the securing wall 15*b* and the rear side of the flange 8 is held by the securing tongues 15*a* together with the securing member 20, i.e., the flange 18 is held between the securing wall 15*b* and the securing tongues 15*a* (see FIG. 6).

Finally, the positioning jig 200 is pulled out of the positioning recess 19 of the projection lens 9 and the jig insertion hole 15*c* in the lens holder 8, and the lens holder 8 is released from the mounting jig 100, whereby the mounting of the projection lens 9 in the lens holder 8 is completed.

Next, a projection lens 9A according to one or more embodiments of the present invention will be described with reference to FIGS. 7 and 8.

Figure 7:
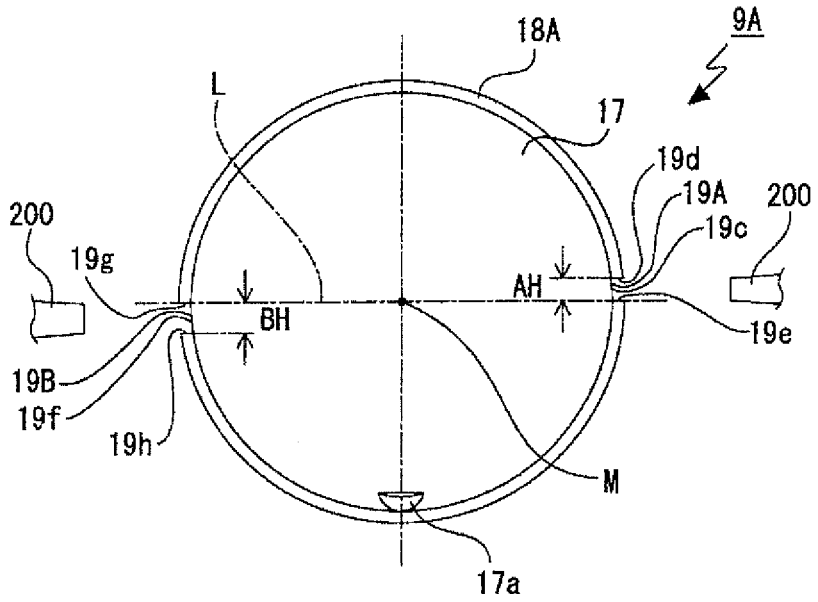
FIG. 7 is a front view of another projection lens according to one or more embodiments of the present invention.

As shown in FIG. 7, the projection lens 9A has a light projecting portion 17 and a flange 18A protruding radially outward from an outer circumferential surface of a rear side of the light projecting portion 17. The light projecting portion 17 and the flange 18A are formed as a one-piece structure.

Positioning recesses 19A, 19B are formed in the flange 18A so as to be opened sideways and in a front-rear direction. Each of the positioning recesses 19A, 19B serves as a positioning portion for positioning the projection lens 9A with respect to the lens holder 8.

The positioning recesses 19A, 19B are formed opposite sides of the projection lens 9A across the center M of the projection lens 9A in the right-left direction. The positioning recess 19A is defined by a bottom face 19*c* which substantially coincides with an outer circumference of the light projecting portion 17 and extending in a circumferential direction of the projection lens 9A (in a substantially vertical direction), a first lateral face 19*d* extending from one end (an upper end) of the bottom face 19*c* with respect to the circumferential direction and facing in the circumferential direction (downwards), and a second lateral face 19*e* extending from the other end (a lower end) of the bottom face 19*c* with respect to the circumferential direction and facing in the circumferential direction (upward). The positioning recess 19B is defined by a bottom face 19*f* which substantially coincides with the outer circumference of the light projecting portion 17 and extending in the circumferential direction of the projection lens 9A (in a substantially vertical direction), a first lateral face 19*g* extending from one end (an upper end) of the bottom face 19*f* with respect to the circumferential direction and facing in the circumferential direction (downwards), and a second lateral face 19*h* extending from the other end (a lower end) of the bottom face 19*f* with respect to the circumferential direction and facing in the circumferential direction (upward).

The positioning recesses 19A, 19B are formed, for example, at locations that are point symmetrical with respect to the center M of the projection lens 9A, such that the second lateral face 19*e* of the positioning recess 19A and the first lateral face 19*g* of the positioning recess 19B coincide with a diameter L extending in the right-left direction through the center M (e.g., coincide with the direction of the diameter L).

Alternatively, the positioning recesses 19A, 19B may be arranged such that the first lateral face 19*d* of the positioning recess 19A and the second lateral face 19*h* of the positioning recess 19B coincide with the diameter L.

The width AH of the positioning recess 19A in the circumferential direction and the width BH of the positioning recess 19B in the circumferential direction are different from each other.

The projection lens 9A is positioned with respect to the lens holder 8 in the direction around the optical axis of the projection lens 9A by engaging the positioning jigs 200, 200 with the positioning recesses 19A, 19B, respectively. The procedure for positioning of the projection lens 9A is similar to the procedure for positioning the projection lens 9 except that two positioning jigs 200, 200 are used, and therefore, detailed description of the procedure for positioning the projection lens 9A will be omitted.

As described above, one end of each of the positioning recesses 19A, 19B of the projection lens 9A with respect to the circumferential direction coincides with the diameter L passing through the center M of the projection lens 9A.

Thus, dimensional tolerance of only one side of each of the positioning recesses 19A, 19B in the circumferential direction affects the positioning of the projection lens 9A with respect to the lens holder 8. Therefore, it is possible to improve positioning accuracy of the projection lens 9A with respect to the lens holder 8.

Figure 8:
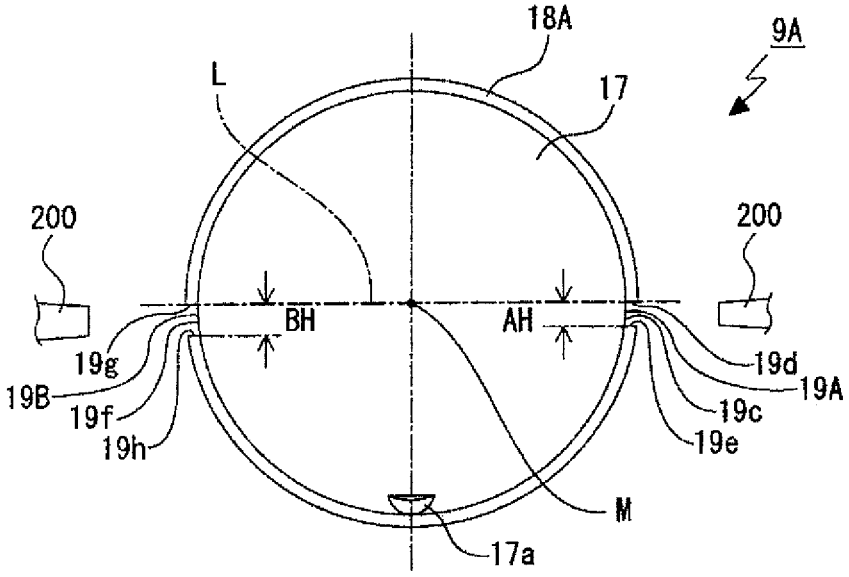
FIG. 8 is a front view of yet another projection lens according to one or more embodiments of the present invention.

As shown in FIG. 8, the positioning recesses 19A, 19B may not be formed at locations that are point symmetrical with respect to the center M of the projection lens 9A. For example, the first lateral face 19*d* of the positioning recess 19A and the first lateral face 19*g* of the positioning recess 19B may coincide with the diameter L. Alternatively, the second lateral face 19*c* of the positioning recess 19A and the second lateral face 19*h* of the positioning recess 19B may coincide with the diameter L.

According to the configuration described above, the projection lens 9A one end of each of the positioning recesses 19A, 19B with respect to the circumferential direction coincides with the diameter L. However, according to one or more embodiments of the present invention, a plurality of positioning recesses may be formed such that one end of each of the positioning recesses with respect to a circumferential direction of a projection lens coincides with a radius of the projection lens (e.g., each of the positioning recesses has a face that coincides with a radial direction extending from the center of the projection lens).

According to such a configuration also, a dimensional tolerance of only one side of the positioning recesses with respect to the circumferential direction affects the positioning of the projection lens with respect to the lens holder 8. Therefore, it is possible to improve positioning accuracy of the projection lens with respect to the lens holder 8.

According to the projection lens 9A described above, the positioning recesses 19A, 19B are formed at locations that are substantially opposite across the center M of the projection lens 9A. Therefore, a distance between the positioning recess 19A and the positioning recess 19B is relatively large, whereby the positioning accuracy of the projection lens 9A with respect to the lens holder 8 is improved accordingly.

When the positioning recesses 19A, 19B are formed at locations that are point symmetrical with respect to the center M of the projection lens 9A, the distance between the positioning recess 19A and the positioning recess 19B becomes maximum, whereby the positioning accuracy of the projection lens 9A with respect to the lens holder 8 is further improved accordingly.

Further, by making the width AH of the positioning recess 19A and the width BH of the positioning recess 19B in the circumferential direction different from each other, the projection lens 9A is positioned with respect to the lens holder 8 with a proper orientation in the circumferential direction, i.e., it possible to prevent an erroneous attachment of the projection lens 9A to the lens holder 8.

As described above, in the vehicle headlamp 1, the positioning jig 200 is inserted through the jig insertion hole 15*c* in the lens holder 8 and is then engaged with (e.g., fitted into) the positioning recess 19 in the projection lens 9, whereby the projection lens 9 is positioned in the direction around the optical axis thereof with respect to the lens holder 8.

Consequently, the projection lens 9 is mounted and held in the lens holder 8 such that the lens holder 8 does not contact the positioning portion 19 of the projection lens 9. Therefore, positioning accuracy of the projection lens 9 with respect to the lens holder 8 can be improved while preventing the occurrence of a crack in the projection lens 9.

While the positioning recess 19 is described as the positioning portion of the projection lens 9 in the embodiments described above, the positioning portion is not limited to the positioning recess 19. For example, according to one or more embodiments, a positioning protrusion may be provided on the projection lens as a positioning portion. In this case, a recess may be formed at the distal end portion of the positioning jig so as to engaged with the positioning protrusion.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A projection lens mounting method for a vehicle headlamp, the vehicle headlamp comprising:
- a light source configured to emit light;
- a reflector configured to reflect the light;
- a projection lens through which the light is projected; and
  - a lens holder holding the projection lens,
- wherein the projection lens comprises a positioning portion, and
- wherein the lens holder is formed with a jig insertion hole at a location corresponding to the positioning portion in a direction around an optical axis of the projection lens,
- the projection lens mounting method comprising:
  - mounting the projection lens to the lens holder such that a surface of the positioning portion is visible through the jig insertion hole;
  - inserting a positioning jig through the jig insertion hole;
  - engaging the positioning jig with the positioning portion; and
  - positioning the projection lens in the direction around the optical axis of the projection lens, and
  - removing the positioning jig out of the jig insertion hole,
- wherein the lens holder comprises a securing wall and a securing tongue, and
- wherein the projection lens mounting method further comprises:
  - bending the securing tongue to press the projection lens toward the securing wall to hold the projection lens with the securing wall therebetween.

2. The projection lens mounting method according to claim 1, wherein the headlamp further comprises a securing member, wherein the projection lens mounting method further comprises: attaching the securing member to the projection lens such that the projection lens is held between the securing wall and the securing member, and wherein the bending comprises holding the projection lens and the securing member between the securing wall and the securing tongue.

3. The projection lens mounting method according to claim 1,
- wherein the projection lens comprises:
  - a front surface, and
  - a rear surface that is opposite to the front surface and that faces the light source,
- wherein the securing wall is provided on a side of the front surface with respect to the projection lens, and
- wherein the securing tongue is provided on a side of the rear surface with respect to the projection lens.

* * * * *